US006964095B2

(12) United States Patent
Jacques

(10) Patent No.: US 6,964,095 B2
(45) Date of Patent: Nov. 15, 2005

(54) METHOD FOR PRODUCING A CRIMP EAR

(75) Inventor: Ralph Jacques, Sarasota, FL (US)

(73) Assignee: Etco, Inc., Warwick, RI (US)

( * ) Notice: Subject to any disclaimer, the term of this patent is extended or adjusted under 35 U.S.C. 154(b) by 79 days.

(21) Appl. No.: 10/653,840

(22) Filed: Sep. 3, 2003

(65) Prior Publication Data

US 2005/0044704 A1 Mar. 3, 2005

(51) Int. Cl.[7] ..... H01R 43/16; H01R 9/24

(52) U.S. Cl. ..... 29/874; 29/874; 29/884; 29/882; 29/838; 29/861; 29/863; 29/825; 439/885; 439/68; 439/70; 439/180

(58) Field of Search ..... 29/874, 884, 882, 29/838, 861, 863, 825; 439/885, 68, 70, 180

(56) References Cited

U.S. PATENT DOCUMENTS 2,748,456 A * 6/1956 Berg ..... 428/572
3,995,365 A * 12/1976 Repplinger ..... 29/882
4,018,177 A * 4/1977 McKee et al. ..... 29/874
4,245,876 A * 1/1981 Ritchie et al. ..... 439/590
5,014,535 A * 5/1991 Marpoe et al. ..... 72/326
5,090,123 A * 2/1992 Hurtgen ..... 29/882
5,226,840 A * 7/1993 Wojtanek ..... 439/733.1
5,879,205 A * 3/1999 Egenolf et al. ..... 439/852
6,325,679 B2 * 12/2001 Sato et al. ..... 439/843

* cited by examiner

*Primary Examiner*—A. Dexter Tugbang
*Assistant Examiner*—Terri Lynn Smith
(74) *Attorney, Agent, or Firm*—Altman & Martin

(57) ABSTRACT

A method of manufacturing an electrical contact with a crimp ear from a flat ribbon of conductive material including applying a force to the ribbon to form an adjacent pair of approximately semicylindrical depressions on opposite sides of the centerline of the ear, shearing the ribbon at the depression bisectors to form a pair of legs on opposites of the centerline, and forming the legs into a predetermined shape about the centerline. Forming the legs includes straightening the legs and bending the legs to the appropriate predetermine relative angle. Optionally, the ear is coined. Optionally, serrations are inscribed across the ear.

6 Claims, 1 Drawing Sheet

METHOD FOR PRODUCING A CRIMP EAR

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical contacts, more particularly, to methods of manufacturing crimp ears.

2. Description of the Related Art

It is well known in the prior art to manufacture electrical contacts by stamping and forming from a continuous strip or ribbon of metallic, conductive material. During the stamping or punching operation, the ribbon is fed into a progressive stamping die that punches profiles of the flat terminals, which are then formed into the desired three-dimensional shape.

The typical electrical contact has a contact portion and a rounded crimp ear for attaching a wire. The inner surface of the crimp ear is typically stamped with narrow grooves or serrations to provide a more secure wire attachment. For some contacts, particularly small contacts, the developed length, that is, the length of the flattened crimp ear, will be greater than the corresponding dimension of the contact end. There are two general methods of forming a crimp ear of this type. In the conventional formed ear method, the ribbon is punched with the ear at its developed length. Features such as coins and serrations are added and the ear is formed to the proper configuration. With this method, ears can be formed with consistent parameters. However, because the developed length is wider than the contact portion, there is wasted material between the contacts. And because the ear is only a small portion of the total length of the contact, on the order of 10–20%, the amount of waste can be significant.

The second method of forming a crimp ear begins by punching an ear no greater than the width of the contact so there is a minimal waste of material between contacts. The ear forming sequence utilizes a swaging operation to achieve the developed length necessary to form the ear. In the five-stage swaging operation shown in FIG. 2, the dies lengthen the ends of the ear by thinning the ear material. In the first stage, the ends of the ear 50 are sheared from the strip 52, as at 54. In the second stage, the ear 50 is preformed by bending it at the longitudinal centerline 56 of the contact. Stage 3 begins the swage formation by pushing material to the ends, as at 58. Stage 4 completes the swage formation by stretching out the ends, as at 60. Stage 5 completes the formation by bending the ear ends to the appropriate angle 62.

Although there is considerably less waste than with the conventional formed ear of the first method described above, the quality of a swaged ear is substandard. Swaging is a severe method of forming. Besides generating excessive friction and tool wear, other process variables, such as variance in lubrication and stamping material properties can have a dramatic effect on the quality of the swaged ear. It has been documented throughout the years that the swaging operation is a costly, labor-intensive forming method in terms of its use in progressive dies. Dimensional tolerances must be liberal when swaging is used.

Additionally, the serrations cannot extend across the developed length of the ear because (1) the swaging operation causes any serrations to distort to the point where they essentially disappear and (2) because the thinner material at the serrations can become weak points in the ear after swaging. Consequently, as shown in FIG. 3, the serrations 64 are restricted to the center of the ear where the material is not stretched during the swaging operation.

BRIEF SUMMARY OF THE INVENTION

An object of the present invention is to provide a method for manufacturing a crimp ear that provides a crimp ear with performance superior to that of the swaged ear and that does not waste material like that of the conventional formed ear.

The present invention is a method of manufacturing an electrical contact with a crimp ear from a tint ribbon of conductive material. The developed length of the crimp ear is formed by stretching the ribbon such that there is a semicylindrical depression on either side of the longitudinal centerline of the crimp ear. Since each depression straddles two crimp ears, the bounds of each crimp ear runs from the bisector of one depression to the bisector of the adjacent depression. The crimp ears are separated by shearing the ribbon at the bisector, resulting in a leg on either side of the centerline. The crimp ear is then preformed about the centerline by straightening the legs. Optionally, the crimp ear is coined. Finally, formation is completed by bending the legs to the appropriate predetermine relative angle. Optionally, the third and fourth steps can be combined into a single step. Optionally, serrations can be inscribed across the developed length of the crimp ear.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
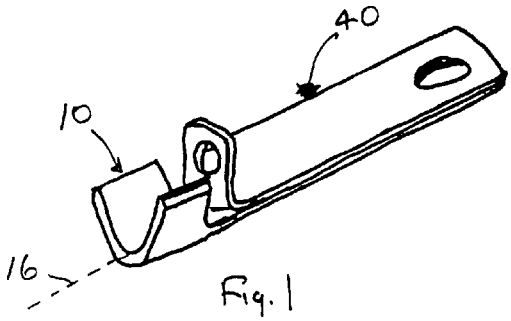
FIG. 1 is a perspective view of a crimp ear formed by the method of the present invention.
Figure 3:
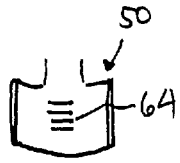
Fig. 3 Prior Art
FIG. 3 is a top view of a slightly spread swaged ear of the prior art with serrations.
Figure 5:
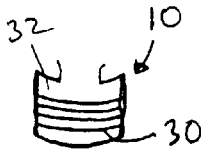
FIG. 5 is a top view of a slightly spread crimp ear formed by the method of the present invention with serrations.
Figure 2:
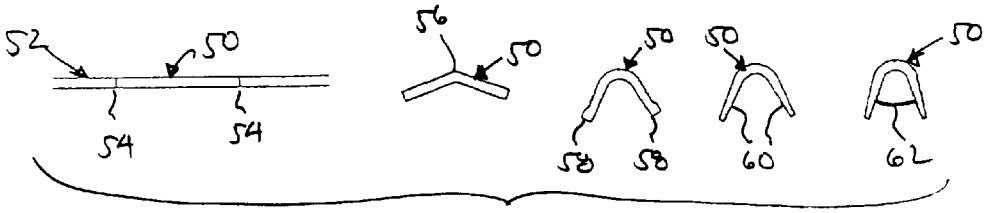
Fig. 2 Prior Art
FIG. 2 shows the forming sequence for the swaged ear of the prior art.

The present invention is a method of manufacturing an electrical contact with a crimp ear. As shown in FIG. 1, an electrical contact has a contact portion 40 and a crimp ear 10 for attaching a wire conductor. Electrical contacts are composed of a conductive metallic materials, such as aluminum and aluminum alloys and copper and copper alloys, the most common being brass.

As is well known in the art, electrical contacts are manufactured by stamping and forming a continuous ribbon of conductive material. The stamping and forming are performed by a series of punches and dies of various shapes that make incremental changes to the ribbon until the contacts are formed. These dies typically make each incremental change to more than one contact at a time.

Figure 4:
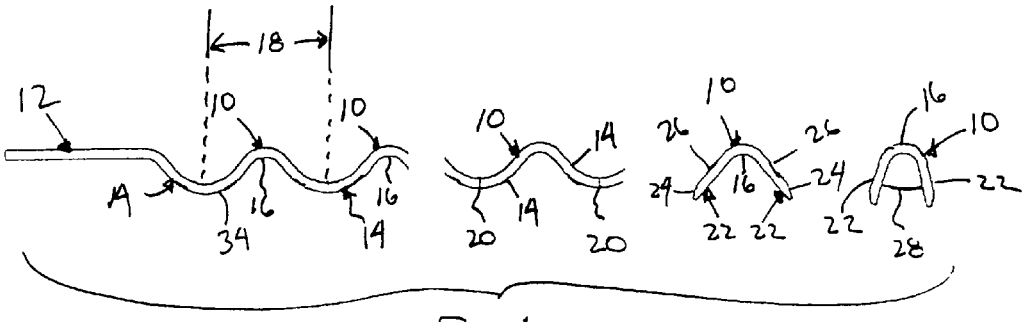
FIG. 4 shows the ear forming sequence of the present invention.

The stamping and forming progression of the method of the present invention is shown in FIG. 4. Note that only the stamping and forming of the crimp ear 10 is shown and described. The stamping and forming of the remainder of the contact 40 is known in the art and is not an aspect of the present invention.

The stamping operation begins with a flat planar ribbon of conductive material 12. In the first step, the developed length of the crimp ear 10 is formed by imparting a force that stretches the material into a generally sinusoidal shape with an approximately semicylindrical depression 14 formed on either side of the longitudinal centerline 16 of the crimp ear 10. Note that each depression 14 straddles two crimp ears 10. The bounds of each crimp ear 10 runs from the bisector 20 of one depression 14 to the bisector 20 of the adjacent depression 14, as shown at 18.

In the second step, the crimp ear 10 is separated from each adjacent crimp ear by shearing the ribbon 12 at the bisector 20 of each depression 14, resulting in a leg 22 on either side of the centerline 16.

In the third step, the crimp ear 10 is preformed about the longitudinal centerline 16 of the crimp ear 10 by straightening the legs 22. Note that the bend centered about the centerline 16 is maintained. Optionally, the crimp ear 10 is coined, that is, the end of each leg 22 is beveled, as at 24. An industrial standard coin is a bevel of approximately 30 degrees from the side surface 26 of the crimp ear 10.

In the fourth step, formation of the crimp ear 10 is completed by bending the legs 22 to the appropriate predetermine relative angle 28. The appropriate angle 28 is predetermined by the eventual use of the contact.

There are several ways known in the art to form the crimp ear as desired. The preferred method is to use a combination of form punches and form dies. Another method includes the use of a rotary die, where the ribbon moves through a pair of oppositely rotating wheels. The outer surface of the wheels are complementarily shaped to form the depressions, shear the ribbon, bend the legs, etc. All methods known in the art for forming the desired shapes is contemplated by the present invention.

The developed length can be significantly increased by the present method without significant degradation of function. For example, a pre-stretched ear length of 0.246 inches can result in a developed length of 0.306 inches after stretching, an increase of 24%. With a material thickness of 0.020 inches, stretching thins it to about 0.018 inches, a decrease of only 10%. As this example shows, by keeping the material intact while stretching, the thinning of the material is dispersed over a greater area, resulting in a more uniform decrease in metal thickness, in this case about 10%. The extent of the stretching and thinning is linked to other factors, such as material composition, area, and the developed length required to make the ear. This ear forming method of the present invention is not restricted to any one material thickness.

The method of the present invention also facilitates serrations that extend across the inner surface 32 of the entire developed length of the crimp ear 10. Prior to the first step, one or more serrations 30 are stamped or otherwise inscribed on the side of the ribbon 12 that will be the outer surface 34 of the depressions 14. The serrations 30 are stamped across the entire length of what will become the developed length of the ear 10, from each bisector 20 to adjacent bisectors 20. Note that the outer surface 34 of the depressions 14 becomes the inner surface of the crimp ear 10 after forming is complete. The stretching step does not significantly distort the serrations 30, so the functionality of the serrations 30 is not significantly reduced. Consequently, the serrations 30 extend across the entire developed length of the ear 10, providing a wire connection that is superior to those of the swaged ear of the prior art.

The stretched ear forming method of the present invention has a number of advantages over the swaging method of the prior art.

1. The quality of the ear is improved. The developed length of the ear is achieved at the first pre-form step, before the contact is separated. This provides better control over the developed length, resulting in better ear height control. It significantly reduces the unevenness variables experienced with swaging.

2. An industry standard 30-degree ear coin can be attained more consistently.

3. Serrations are significantly improved. By not swaging the sides of the ear to achieve growth, serrations cover the entire developed length.

4. Terminals requiring different ear sizes can be accommodated more easily because fewer dies need to be changed from one ear size to another.

5. Eliminating the high-maintenance swaging operation significantly improves die performance.

6. With the dramatic reduction in friction, lubrication is less of an issue, which translates into cost savings.

7. There are fewer stages to the forming process, resulting in reduced initial cost and reduced maintenance costs.

The stretched ear forming method of the present invention also has an advantage over conventional ear form methods of the prior art in that progressive dies where the crimp ear governs the progression or feed, can be designed at a smaller progression, thus reducing wasted material.

Thus it has been shown and described a method for producing a crimp ear on an electrical contact that satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A method for producing a crimp ear of an electrical contact having a longitudinal centerline, said method comprising the steps of:

(a) providing a planar ribbon of conductive material;

(b) applying a force to said ribbon to form an adjacent pair of approximately semicylindrical depressions, each of said depressions having a bisector;

(c) shearing said ribbon at said bisector of each of said depressions to form a pair of legs on opposite sides of said centerline; and (d) forming said legs into a predetermined shape about said centerline.

2. The method of claim 1 wherein said forming includes straightening said legs and bending said legs about said centerline to a predetermined relative angle.

3. The method of claim 1 wherein said method further comprises coining said legs.

4. The method of claim 1 wherein said depressions have an outer surface on a first side of said ribbon and said method further comprises inscribing at least one serration in said first side, said at least one serration extending between said bisector of each of said depressions.

5. A method for producing a crimp ear of an electrical contact having a longitudinal centerline, said method comprising the steps of:

(a) providing a planar ribbon of conductive material;

(b) applying a force to said ribbon to form an adjacent pair of approximately semicylindrical depressions, each of said depressions having a bisector;

(c) shearing said ribbon at said bisector of each of said depressions to form a pair of legs on opposite sides of said centerline;

(d) straightening said legs;

(e) coining said legs; and (f) bending said legs about said centerline to a predetermined relative angle.

6. The method of claim 5 wherein said depressions have an outer surface on a first side of said ribbon and said method further comprises inscribing at least one serration in said first side, said at least one serration extending between said bisector of each of said depressions.

* * * * *